US010913062B2

(12) United States Patent
Perroud et al.

(10) Patent No.: US 10,913,062 B2
(45) Date of Patent: Feb. 9, 2021

(54) BEAD SEPARATION IN MICROFLUIDICS

(71) Applicant: TECAN TRADING AG, Mannedorf (CH)

(72) Inventors: Thomas Perroud, Lexington, MA (US); Daniel Tran, San Jose, CA (US); Daniel Hoffmeyer, San Jose, CA (US); Tiffany Lay, San Jose, CA (US); Manjeet Dhindsa, San Jose, CA (US)

(73) Assignee: TECAN TRADING AG, Mannedorf (CH)

( * ) Notice: Subject to any disclaimer, the term of this patent is extended or adjusted under 35 U.S.C. 154(b) by 237 days.

(21) Appl. No.: 15/756,209

(22) PCT Filed: Sep. 1, 2016

(86) PCT No.: PCT/US2016/049952

§ 371 (c)(1),
(2) Date: Feb. 28, 2018

(87) PCT Pub. No.: WO2017/040818

PCT Pub. Date: Mar. 9, 2017

(65) Prior Publication Data

US 2018/0339923 A1 Nov. 29, 2018

(51) Int. Cl.
*B01L 3/00* (2006.01)

(52) U.S. Cl.
CPC ..... *B01L 3/502715* (2013.01); *B01L 3/508* (2013.01); *B01L 3/50273* (2013.01);
(Continued)

(58) Field of Classification Search
CPC ..... C02F 1/484; B01L 3/502715; B01L 3/50273; B01L 3/508; B01L 3/502792;
(Continued)

(56) References Cited

U.S. PATENT DOCUMENTS 5,486,337 A 1/1996 Ohkawa
6,565,727 B1 5/2003 Shenderov
(Continued)

FOREIGN PATENT DOCUMENTS

WO 2006125767 A1 11/2006
WO 2008106678 A1 9/2008
(Continued)

OTHER PUBLICATIONS

International Search Report for corresponding PCT application No. PCT/US2016/049952, dated Nov. 23, 2016.
(Continued)

*Primary Examiner* — David C Mellon
(74) *Attorney, Agent, or Firm* — Notaro, Michalos & Zaccaria P.C.

(57) ABSTRACT

Digital microfluidics system with electrodes attached to a PCB has control unit for manipulating liquid droplets by electrowetting, cartridge accommodation site for taking up a disposable cartridge having a working gap in-between two hydrophobic surfaces, and magnetic conduit/backing combination. A barrier element on an individual electrode of the PCB for narrowing the working gap. A disposable cartridge is positioned at the cartridge accommodation site, its flexible working film touching there and of the barrier element an uppermost surface. In the working gap and above a path of selected electrodes a liquid portion or liquid droplet with magnetically responsive beads moves by electrowetting on the electrode path until a magnetic field of the magnetic conduit is reached. The backing magnet is activated before and during the moving to thereby attract and remove magnetically responsive beads therefrom.

13 Claims, 4 Drawing Sheets

Figure 1:
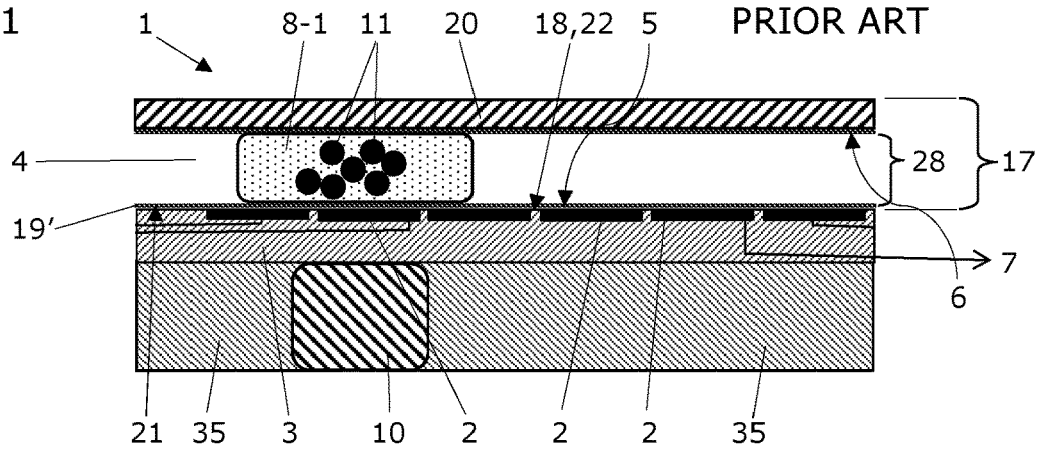

(52) U.S. Cl.
CPC ... *B01L 3/502761* (2013.01); *B01L 3/502792* (2013.01); *B01L 2200/025* (2013.01); *B01L 2200/0668* (2013.01); *B01L 2300/0816* (2013.01); *B01L 2300/123* (2013.01); *B01L 2400/043* (2013.01); *B01L 2400/0427* (2013.01)

(58) Field of Classification Search
CPC ..... B01L 3/502761; B01L 2200/025; B01L 2200/0668; B01L 2300/0816; B01L 2300/123; B01L 2400/0427; B01L 2400/043
See application file for complete search history.

(56) References Cited

U.S. PATENT DOCUMENTS

| | | | | |
|---|---|---|---|---|
| 7,816,121 | B2 | 10/2010 | Pollack et al. | |
| 7,851,184 | B2 | 12/2010 | Pollack et al. | |
| 8,927,296 | B2 | 1/2015 | Sista et al. | |
| 2009/0298059 | A1 | 12/2009 | Gumbrecht | |
| 2010/0270156 | A1* | 10/2010 | Srinivasan | F04B 19/006 204/450 |
| 2010/0279374 | A1 | 11/2010 | Sista et al. | |
| 2013/0126358 | A1 | 5/2013 | Lee et al. | |
| 2013/0134040 | A1 | 5/2013 | Lee et al. | |
| 2013/0175169 | A1 | 7/2013 | Feiglin et al. | |
| 2013/0270114 | A1 | 10/2013 | Feiglin | |

FOREIGN PATENT DOCUMENTS

| | | | |
|---|---|---|---|
| WO | 2010069977 | A1 | 6/2010 |
| WO | 2011002957 | A2 | 1/2011 |

OTHER PUBLICATIONS

Written Opinion for orresponding PCT application No. PCT/US2016/049952, dated Mar. 9, 2017.

* cited by examiner

BEAD SEPARATION IN MICROFLUIDICS

RELATED PATENT APPLICATIONS

The present patent application claims priority of the co-pending patent application PCT/US2015/048141 filed on Sep. 2, 2015, the content of which is herein incorporated in its entirety for any purpose.

FIELD OF TECHNOLOGY

The present invention relates to the control and manipulation of liquids in a small volume, usually in the micro- or nanoscale format. In digital microfluidics, a defined voltage is applied to electrodes of an electrode array, so that individual droplets are addressed (electrowetting). For a general overview of the electrowetting method, please see Washizu, IEEE Transactions on Industry Applications, Volume 34, No. 4, 1998, and Pollack et al., Lab chip, 2002, Volume 2, 96-101. Briefly, electrowetting refers to a method to move liquid droplets using arrays of microelectrodes, preferably covered by a hydrophobic layer that is used as a working surface. By applying a defined voltage to electrodes of the electrode array, a change of the surface tension of the liquid droplet, which is present on the addressed electrodes, is induced. This results in a remarkable change of the contact angle of the droplet on the addressed electrode, hence in a movement of the droplet. For such electrowetting procedures, two principle ways to arrange the electrodes are known: using one single working surface with an electrode array for inducing the movement of droplets in a monoplanar setup or adding a second surface that is opposite a similar electrode array and that provides at least one ground electrode in a biplanar setup. A major advantage of the electrowetting technology is that only a small volume of liquid is required, e.g. a single droplet. Thus, liquid processing can be carried out within considerably shorter time. Furthermore, the control of the liquid movement can be completely under electronic control resulting in automated processing of samples.

In life science and diagnostic applications, extraction and purification of biomolecules often is done via functionalized magnetically responsive beads (or magnetic beads for short). During extraction, the targeted biomolecules bind specifically to the surface of the beads via chemical moieties. After immobilizing the magnetic beads with a magnetic force, undesirable biomolecules and fluids are removed, usually with a pipette or passing fluid flow. Optimal extractions are defined as ones with a maximum retention of desired biomolecules, and a maximum removal of un-wanted biomolecules; in practice, these requirements translate into maximizing bead retention while minimizing leftover fluid. Many parameters affect the efficiency of extraction and clean-up: the number of binding sites available as determined by the number of magnetic beads and the number of binding sites per bead, the speed with which the beads and binding molecules interact, the avidity with which the beads and captured biomolecules bind to each other, the strength of the magnetic field on the beads, the gradient of that magnetic field and the force with which the wash fluid moves past the magnetic beads.

Electrowetting with magnetic beads is an extremely attractive means by which to run heterogeneous assays that require serial binding and washing steps. Binding is extremely efficient in this microfluidic format as the beads can be mixed while the binding is taking place therefore effectively reducing diffusion distances. Washing is also efficient as most of the liquid can be removed when droplets are pulled away from the beads. A challenge with electrowetting systems that is similar to one with conventional systems is to hold the beads against the interfacial tension of the aqueous droplet and a filler-fluid (which e.g. is oil or air). In order to prevent the magnetic beads from being swept away, it is desirable to have a strong magnetic force that concentrates the beads in a small area to better enable a bead pellet to resist the tendency of the interface to sweep magnetic beads away.

In standard electrowetting devices, it is desirable to put magnets underneath the PCB (=printed circuit board) containing driving electrodes for electrowetting to pull magnetic beads out of a droplet. In film-based electrowetting in which the PCB is part of the instrument and not part of the consumable, one has the luxury of being able to incorporate many features directly into the PCB. This leads to increased PCB layers and therefore to a thicker PCB thickness. An example is an extra layer to accommodate embedded heaters. The amplitude of magnetic fields and gradients strongly depends on the distance between the magnet and the location of interest so a thick PCB reduces the effective magnetic force on the droplets and magnetic beads. A common way to generate strong magnetic fields into an electrowetting system is to use large magnets underneath the PCB.

Such large magnets as positioned below the PCB have several disadvantages:

- they take up considerable space in the instrument,
- magnetic force is reduced at the bead location because it is relatively far away,
- the magnetic gradient is more diffuse,
- location of bead extraction is ill-defined because the magnetic field is spread out,
- magnets must be carefully aligned with the PCB to ensure that the magnetic bead extraction location is compatible with the electrowetting droplet motion.

RELATED PRIOR ART

Automated liquid handling systems are generally well known in the art. An example is the Freedom EVO® robotic workstation from the present applicant (Tecan Schweiz AG, Seestrasse 103, CH-8708 Mannedorf, Switzerland). These automated systems are larger systems that are not designed to be portable and typically require larger volumes of liquids (microliter to milliliter) to process.

A device for liquid droplet manipulation by electrowetting using one single surface with an electrode array (a monoplanar arrangement of electrodes) is known from the U.S. Pat. No. 5,486,337. All electrodes are placed on a surface of a carrier substrate, lowered (embedded) into the substrate, or covered by a non-wettable (i.e. hydrophobic) surface. A voltage source is connected to the electrodes. Droplets are moved by applying a voltage to subsequent electrodes, thus guiding the movement of the liquid droplet above the electrodes according to the sequence of voltage application to the electrodes.

An electrowetting device for microscale control of liquid droplet movements, using an electrode array with an opposing surface with at least one ground electrode is known from U.S. Pat. No. 6,565,727 (a biplanar arrangement of electrodes). Each surface of this device may comprise a plurality of electrodes. The two opposing arrays form a gap. The surfaces of the electrode arrays directed towards the gap are preferably covered by an electrically insulating, hydrophobic layer. The liquid droplet is positioned in the gap and moved within a non-polar filler fluid by consecutively applying a plurality of electric fields to a plurality of electrodes positioned on the opposite sides of the gap.

The use of an electrowetting device for manipulating liquid droplets in the context of the processing of biological samples is known from the international patent application published as WO 2011/002957 A2. There, it is disclosed that a droplet actuator typically includes a bottom substrate with the control electrodes (electrowetting electrodes) insulated by a dielectric, a conductive top substrate, and a hydrophobic coating on the bottom and top substrates. The cartridge may include a ground electrode, which may be replaced or covered by a hydrophobic layer, and an opening for loading samples into the gap of the cartridge. Interface material (e.g. a liquid, glue or grease) may provide adhesion of the cartridge to the electrode array.

Disposable cartridges for microfluidic processing and analysis in an automated system for carrying out molecular diagnostic analysis are disclosed in WO 2006/125767 A1 (see US 2009/0298059 A1 for English translation). The cartridge is configured as a flat chamber device (with about the size of a check card) and can be inserted into the system. A sample can be pipetted into the cartridge through a port and into processing channels.

Droplet actuator structures are known from the international patent application WO 2008/106678. This document particularly refers to various wiring configurations for electrode arrays of droplet actuators, and additionally discloses a two-layered embodiment of such a droplet actuator which comprises a first substrate with a reference electrode array separated by a gap from a second substrate comprising control electrodes. The two substrates are arranged in parallel, thereby forming the gap. The height of the gap may be established by spacer. A hydrophobic coating is in each case disposed on the surfaces which face the gap. The first and second substrate may take the form of a cartridge, eventually comprising the electrode array.

From US 2013/0270114 A1, a digital microfluidics system for manipulating samples in liquid droplets within disposable cartridges is known. The disposable cartridge comprises a bottom layer, a top layer, and a gap between the bottom and top layers. The digital microfluidics system comprises a base unit with at least one cartridge accommodation site that is configured for taking up a disposable cartridge, at least one electrode array comprising a number of individual electrodes and being supported by a bottom substrate, and a central control unit for controlling selection of the individual electrodes of said at least one electrode array and for providing these electrodes with individual voltage pulses for manipulating liquid droplets within said cartridges by electrowetting.

U.S. Pat. No. 7,816,121 B2 and U.S. Pat. No. 7,851,184 B2 disclose a droplet actuation system and corresponding method of its use. The system comprises a substrate with electrowetting electrodes (or PCB), temperature control means for carrying out PCR-based nucleic acid amplification in droplets, means for effecting a magnetic field in proximity to electrowetting electrodes for immobilizing magnetically responsive beads in droplets that are located in a gap on the PCB. The processor, the electrowetting electrodes, and the magnetic field are configured to cause splitting of a droplet comprising magnetically responsive beads. Using the system for splitting droplets yields two daughter droplets, one with magnetically responsive beads and one with substantially reduced amount of beads. Means for effecting a magnetic field may comprise on a side of the gap opposite to the PCB a magnet and means for moving the magnet into and out of proximity with electrowetting electrodes.

U.S. Pat. No. 8,927,296 B2 discloses a method of reducing liquid volume surrounding beads. The method encompasses the steps of providing, in an operations gap of a digital microfluidics system, a droplet that comprises one or more magnetically responsive beads. The method further encompasses exposing these beads in the droplet to a magnetic field of the digital microfluidics system, and separating the droplet from the magnet field by electrowetting. As a result of the method, the magnetically responsive beads remain in the magnetic field and in a sub-droplet atop an electrowetting electrode of the digital microfluidics system.

When working with magnetically responsive beads, another common problem is settling of the beads or clumping of beads that have already been in the presence of a strong magnet field. On the bench, such clumping is typically remedied by vortexing the bead solution. However, with electrowetting based systems it is a challenge to find methods to sufficiently stir up the magnetic beads via electrowetting manipulations, especially since fluid flow in most microfluidic systems can be characterized as laminar. Suspension and re-suspension of beads is important for efficient bead washing, increasing binding-site surface area, and promoting uniformity of bead concentrations in daughter droplets formed via electrowetting from a larger bulk of magnetic beads.

OBJECTS AND SUMMARY OF THE PRESENT INVENTION

It is an object of the present invention to suggest alternative devices for and/or alternative methods of substantially removing magnetically responsive beads from droplets on a working surface in digital microfluidics. It is another object of the present invention to suggest alternative devices for and/or alternative methods of substantially re-suspending magnetically responsive beads in droplets on a working surface in digital microfluidics.

According to a first aspect and in particular for re-suspension of magnetically responsive beads, these objects are achieved by the arrangement of at least one barrier element positioned at least partially on an operating electrode located at a cartridge accommodation site of a PCB of a digital microfluidics system. The barrier element narrows the working gap between a flexible working film and hydrophobic cover surface of a disposable cartridge that situated on a surface of this cartridge accommodation site. Preferably, the flexible working film of the cartridge is pressed to the surface of the cartridge accommodation site by underpressure between the cartridge and its accommodation site or by internal overpressure inside of the working gap of the cartridge.

According to a second aspect and in particular for substantially removing magnetically responsive beads from droplets, these objects are achieved by the additional integration of a magnetic conduit into the PCB of a digital microfluidics system that is equipped with at least one backing magnet for magnetic bead separation during electrowetting operations in the gap of a disposable cartridge. Preferably, the magnetic conduit is located on top of such a backing magnet and below a path of a droplet that is manipulated by electrowetting.

According to a third aspect, these objects are achieved by the arrangement of two barrier elements and a magnetic conduit/backing magnet combination for magnetic bead separation and re-suspension, the barrier elements being positioned upstream and downstream of the magnetic conduit/backing magnet combination that is located at an electrowetting droplet path.

Additional and inventive features, preferred embodiments, and variants of the present invention derive from the respective dependent claims.

Advantages of the present invention comprise:

- Provision of at least one (preferably two) barrier elements narrows the working gap between a flexible working film and hydrophobic cover surface of a disposable cartridge that situated on a surface of this cartridge accommodation site. Such provision provides substantial reduction of beads in a droplet moved over a magnet and a barrier element.
- Positioning at least one (preferably two) barrier elements on operating electrodes located at a cartridge accommodation site of a PCB of a digital microfluidics system enable the use of standard disposable cartridges without any need of integrating gap-reducing barrier elements inside the cartridge, and without any need of precise positioning or alignment of the disposable cartridges on the PCB.
- Applying underpressure between the cartridge and its accommodation site provides good contact of the cartridge's flexible working film backside with the surface of the digital microfluidics system cartridge accommodation site.
- Applying overpressure inside of the working gap of the disposable cartridge alternatively provides good contact of the cartridge's flexible working film backside with the surface of the digital microfluidics system cartridge accommodation site.
- Provision of a magnetic conduit with a backing magnet results in stronger and more localized magnetic forces directed to magnetically responsive beads in liquid portions or droplets manipulated by digital microfluidics.
- Provision of a magnetic conduit with a backing magnet results in steeper gradients of magnetic forces for enhanced bead-based extractions and purifications in liquid portions or droplets manipulated by digital microfluidics.
- The location of the magnetic conduit within the PCB enables a precise positioning of the immobilized beads on the top surface of a working film or PCB.
- There is no need of careful alignment of the backing magnet and the magnetic conduit, because only the magnetic conduit is defining the site of attraction for magnetically responsive beads.
- Magnetic conduits can be located in a first substrate or PCB and/or in a second substrate that encloses a gap with the PCB.
- Combinations of magnetic conduits and backing magnets provide improved reduction of beads in a droplet moved away from the magnetic conduits.
- Combinations of magnetic conduits/backing magnets and barrier elements that narrow the working gap of a disposable cartridge provide further enhanced reduction of beads in a droplet moved away from the magnetic conduits and over a barrier element.

BRIEF INTRODUCTION OF THE DRAWINGS

Figure 2:
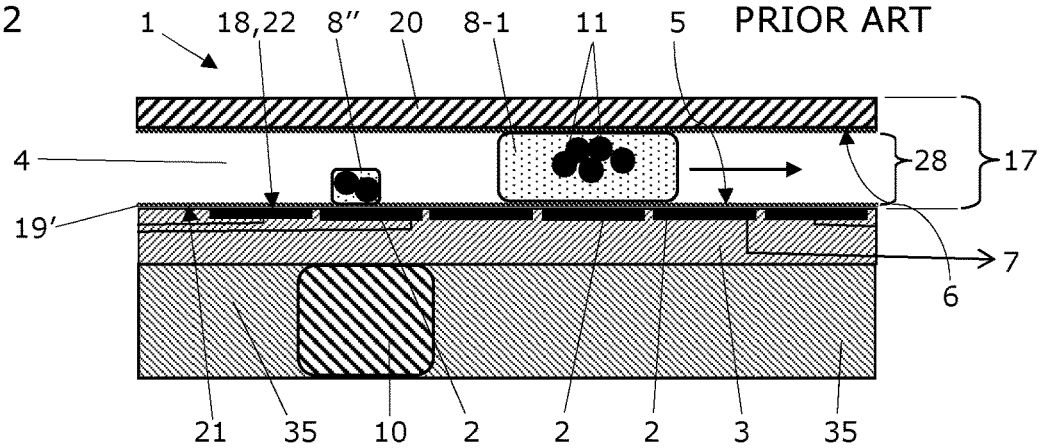
Figure 3:
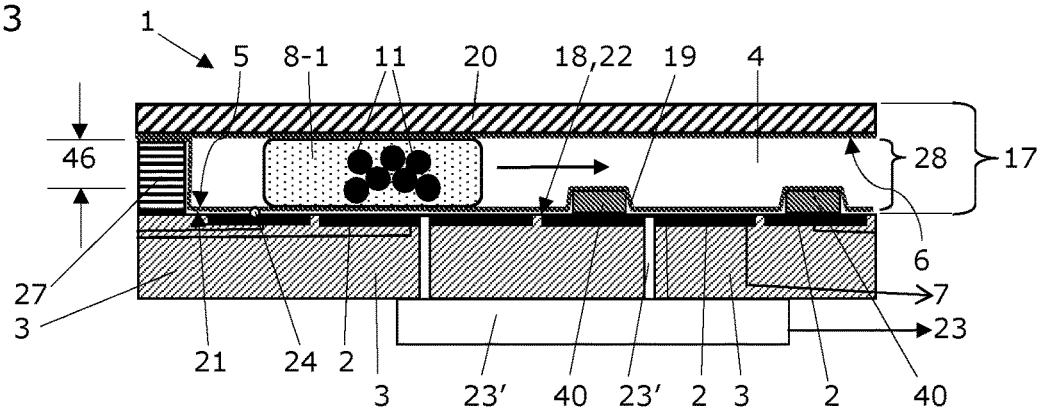
Figure 4:
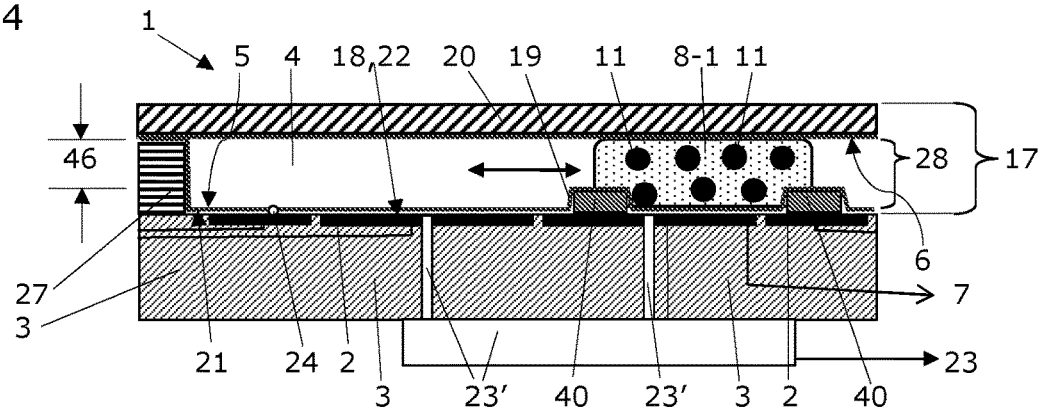
Figure 5:
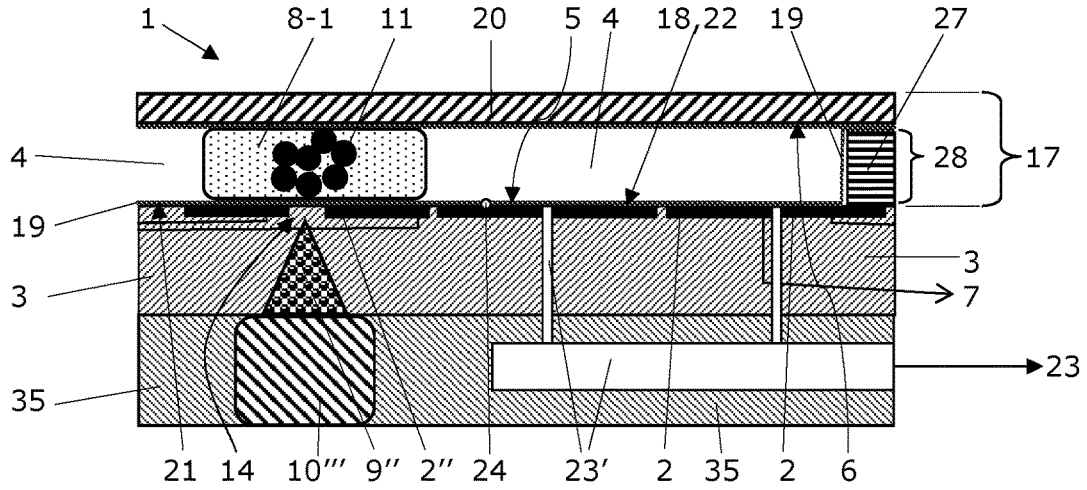
Figure 6:
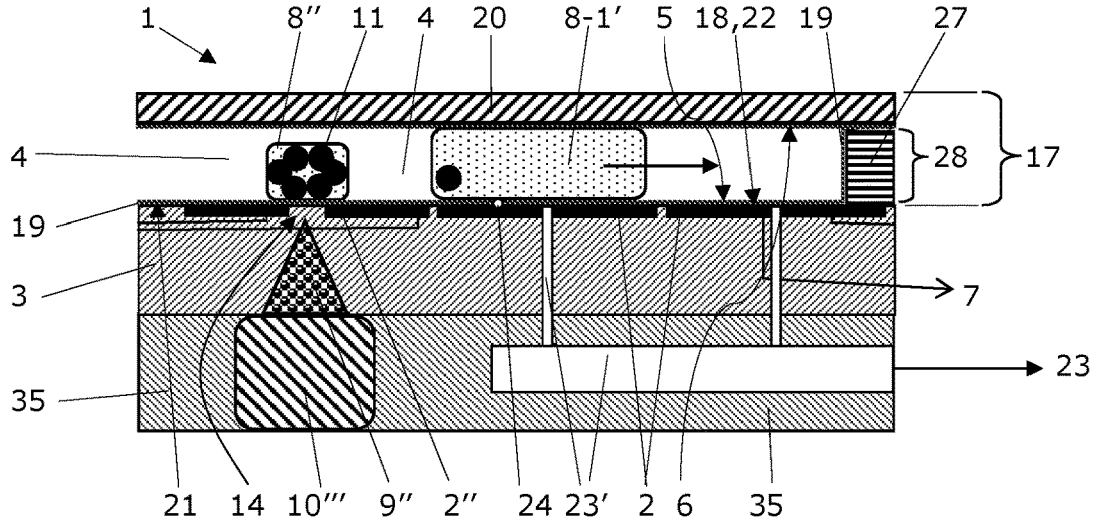
Figure 7:
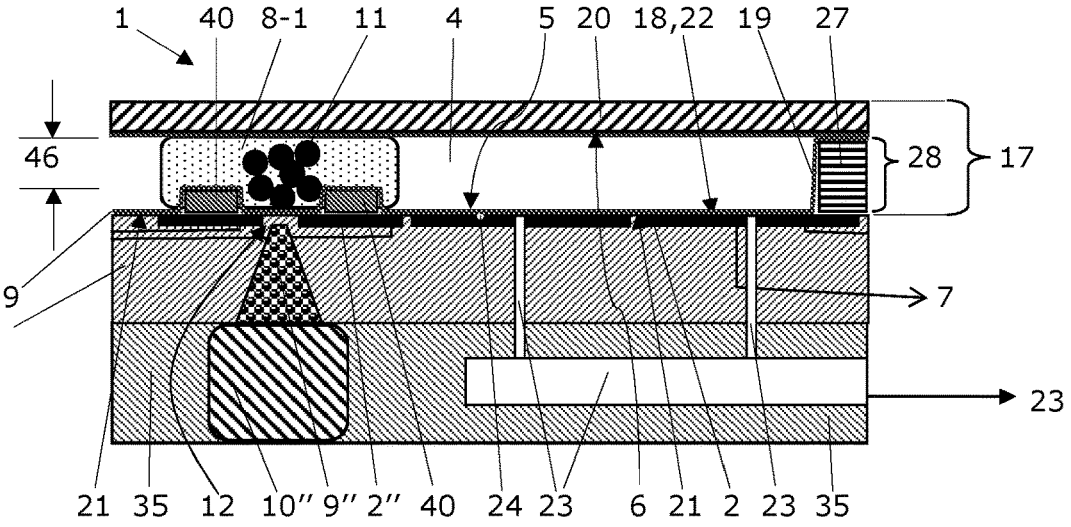
Figure 8:
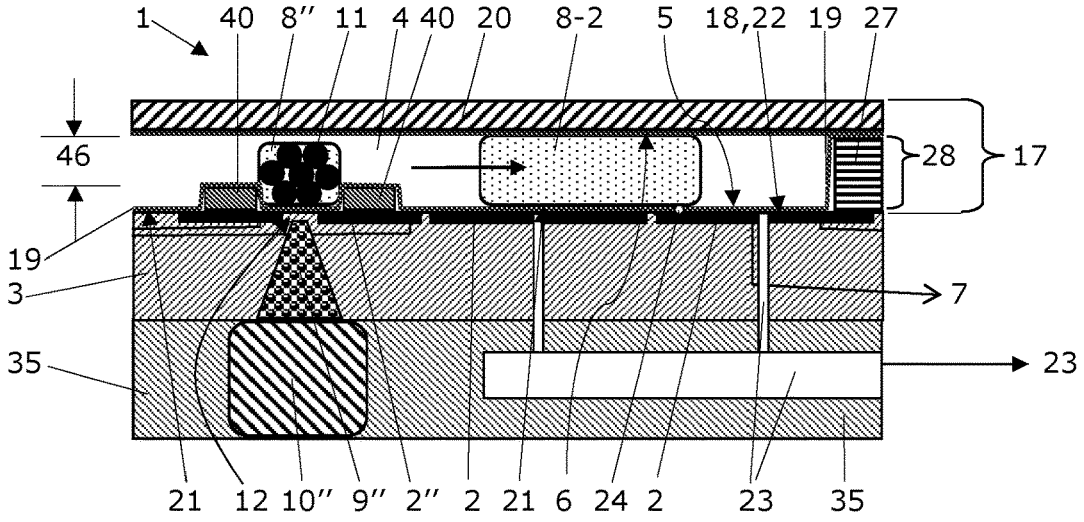
Figure 9:
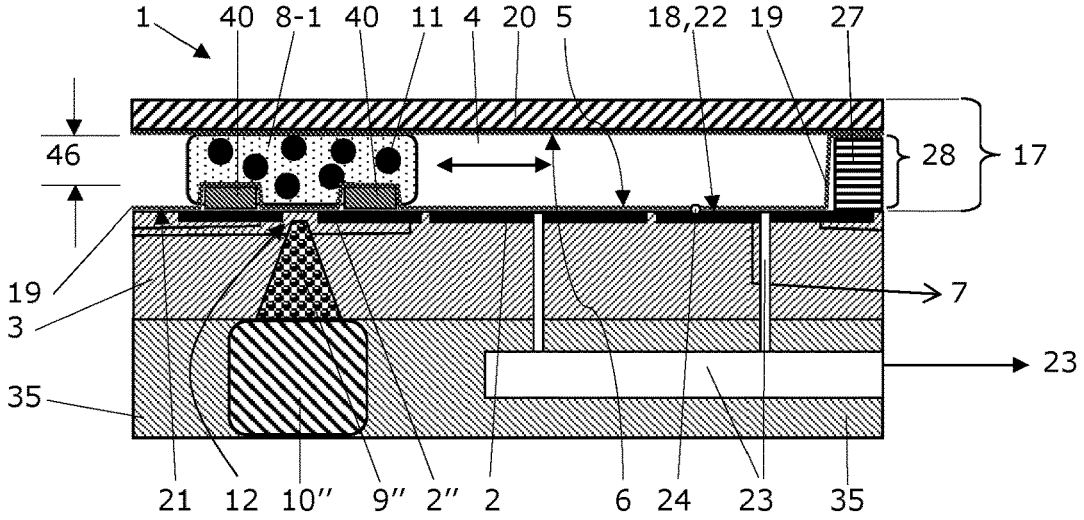
Figure 10:
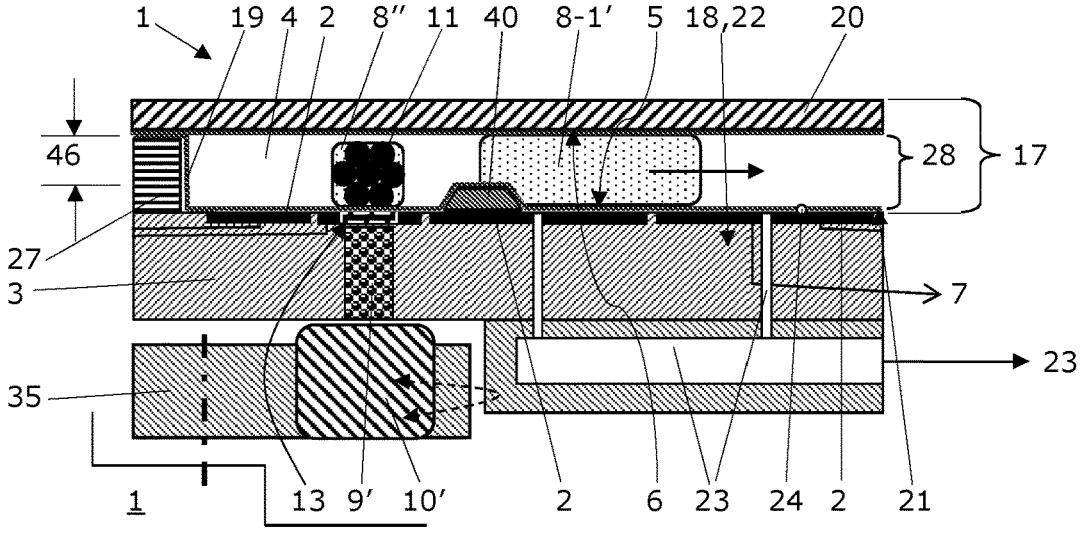
Figure 11:
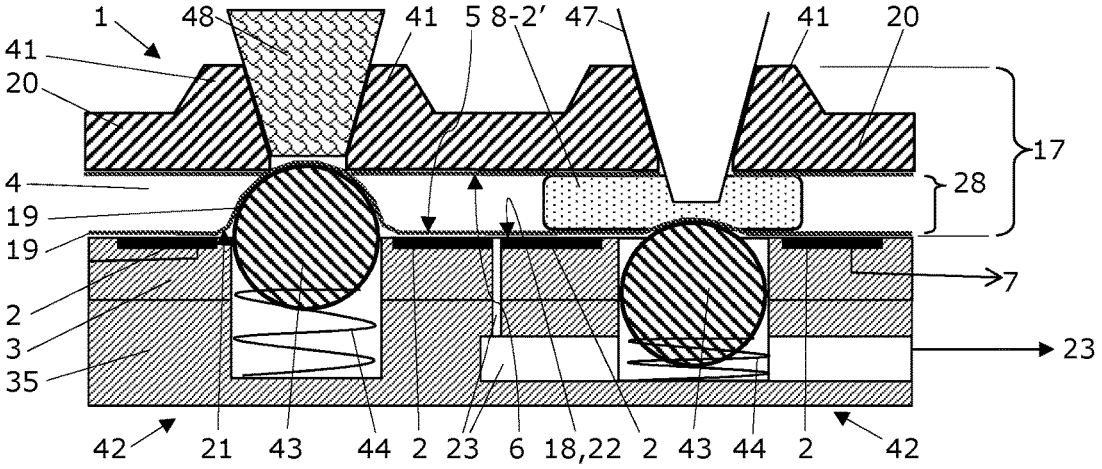
Figure 12:
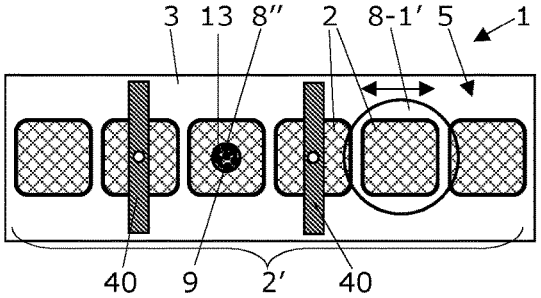
Figure 13:
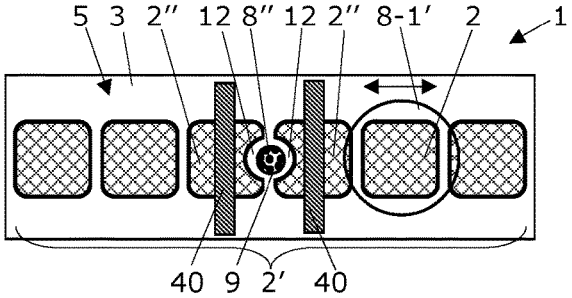
Figure 14:
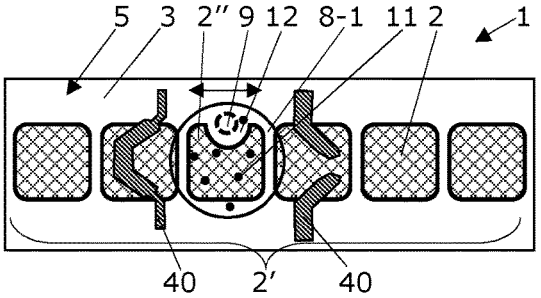
Figure 15:
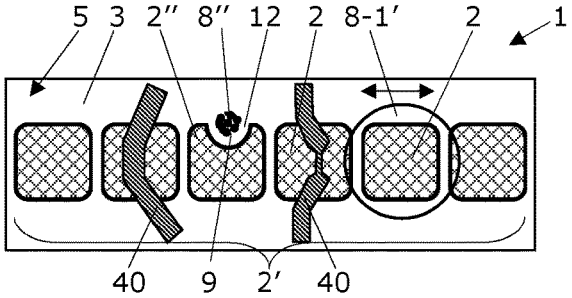
Figure 16:
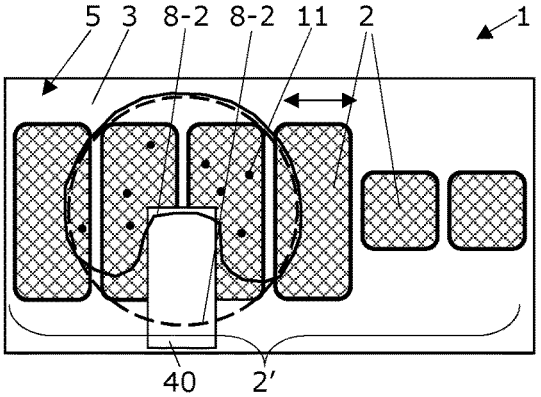
Figure 17:
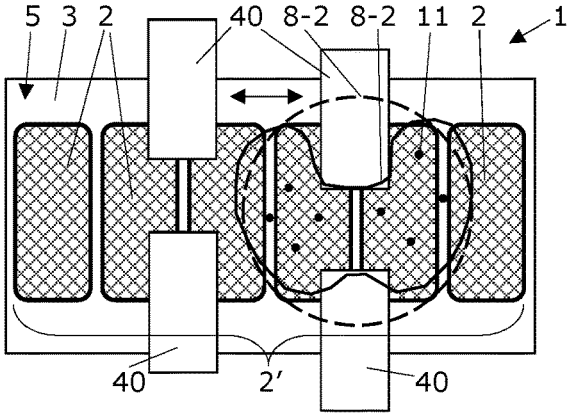

Integration of barrier elements that narrow the working gap of a disposable cartridge as well as integration of magnetic conduits into the PCB or first substrate and/or second substrate according to the present invention is described with the help of the attached schematic drawings that show selected and exemplary embodiments of the present invention without narrowing the scope and gist of this invention. It is shown in:

FIG. 1 a biplanar setup known from the prior art in a cross section view with a disposable cartridge located at a cartridge accommodation site of a PCB of a digital microfluidics system with an activated magnet located below an individual operation electrode and a droplet with concentrated beads in the magnetic field on top;

FIG. 2 the biplanar setup known from the prior art of the cross section view of FIG. 1, the droplet with beads clumped by the magnet field moved away from the magnetic field;

FIG. 3 an inventive biplanar setup in a cross section view with a disposable cartridge located at a cartridge accommodation site of a PCB of a digital microfluidics system with two barrier elements located on two individual operation electrodes adjacent to a single operation electrode and a droplet with beads clumped by a magnetic field on top another electrode;

FIG. 4 the inventive biplanar setup of the cross section view of FIG. 3 with the droplet moved (preferably repeated) over at least one of the barrier elements, the droplet comprising re-dispersed magnetically responsive beads;

FIG. 5 an alternative biplanar setup in a cross section view with a disposable cartridge located at a cartridge accommodation site of a PCB of a digital microfluidics system with one conical, pyramidal magnetic conduit located in a PCB or first substrate and backed with an activated, individual backing magnet; the magnetic conduit being located in a blind hole below a space between two narrowed operation electrodes;

FIG. 6 the alternative biplanar setup of the cross section view of FIG. 5 with the droplet moved away from the magnetic conduit, the droplet comprising a considerably reduced number of beads leaving a small liquid portion with beads behind;

FIG. 7 an inventive biplanar setup in a cross section view with a disposable cartridge located at a cartridge accommodation site of a PCB of a digital microfluidics system with one frustoconical magnetic conduit located in a PCB or first substrate and backed with an activated, individual backing magnet in combination with two barrier elements at least partially located on two individual operation electrodes adjacent to the magnetic conduit, which is located in a blind hole below a space between two narrowed operation electrodes and which has a droplet with concentrated beads on top;

FIG. 8 the inventive biplanar setup of the cross section view of FIG. 7 with the droplet moved away from the magnetic conduit, the droplet substantially comprising no beads leaving a small liquid portion with practically all beads behind;

FIG. 9 the inventive biplanar setup of the cross section view of FIGS. 7 and 8 with the droplet moved back to the magnetic conduit with the now deactivated backing magnet, all beads being present again and dispersed in the droplet;

FIG. 10 an inventive biplanar setup in a cross section view with a disposable cartridge located at a cartridge accommodation site of a PCB of a digital microfluidics system with one cylindrical magnetic conduit located below the center of an electrowetting electrode, the magnetic conduit being located in the PCB or first substrate and backed with an activated, individual backing magnet in combination with a single barrier element located on an individual operation electrode adjacent to the magnetic conduit; the droplet moved over the barrier element comprises practically no beads leaving a small liquid portion with substantially all beads behind on top of the magnetic conduit;

FIG. 11 an inventive biplanar setup in a cross section view with a disposable cartridge located at a cartridge accommodation site of a PCB of a digital microfluidics system with two check valves located between electrowetting electrodes, the check valves each being located in the PCB or first substrate and in projection under a pipetting guide of the disposable cartridge:

on the left, the check valve is closed by pushing the valve ball up by the valve spring, this enables establishing an overpressure in the filler fluid inside of the gap;

on the right, the check valve is open by pressing a liquid (here a sample portion) via the sealing pipetting guide into the gap of the disposable cartridge, such liquid injection moves the valve ball against the force of the valve spring and opens the check valve;

FIG. 12 a plane view of a linear array of operation electrodes on a PCB of a digital microfluidics system; a single magnetic conduit positioned on an activated backing magnet is located below the center of an electrowetting electrode in the path of a droplet; two barrier elements according to a first embodiment are at least partially located on two individual operation electrodes adjacent to the electrode with the magnetic conduit; the droplet being moved away from the electrode with the magnetic conduit and over a barrier element, the droplet substantially comprises no beads leaving a small liquid portion with practically all beads behind on top of the magnetic conduit;

FIG. 13 a plane view of a linear array of operation electrodes on a PCB of a digital microfluidics system; a single magnetic conduit is located in neighboring notches in-between two of the electrowetting electrodes that in each case define the path, the magnetic conduit being positioned on an activated backing magnet; two barrier elements according to a second embodiment are at least partially located on two individual operation electrodes adjacent to the magnetic conduit; the droplet being moved away from the magnetic conduit and over a barrier element, the droplet substantially comprises no beads leaving a small droplet with practically all beads behind on top of the magnetic conduit;

FIG. 14 a plane view of a linear array of operation electrodes on a PCB of a digital microfluidics system; a single magnetic conduit is located in a notch at one side of one of the electrowetting electrodes that define the electrowetting path, the magnetic conduit being positioned on an inactive backing magnet; two barrier elements according to a third and fourth embodiment are at least partially located on two individual operation electrodes adjacent to the electrode with the magnetic conduit on which is the droplet that comprises all dispersed beads;

FIG. 15 a plane view of a linear array of operation electrodes on a PCB of a digital microfluidics system; a single magnetic conduit is located in a notch at one side of one of the electrowetting electrodes that define the electrowetting path, the magnetic conduit being positioned on an activated backing magnet; two barrier elements according to a fifth and sixth embodiment are at least partially located on two individual operation electrodes adjacent to the electrode with the magnetic conduit; the droplet being moved away from the magnetic conduit and over a barrier element, the droplet substantially comprises no beads leaving a small liquid portion with practically all beads behind on top of the magnetic conduit;

FIG. 16 a plane view of a linear array of operation electrodes on a PCB of a digital microfluidics system; two types of electrodes are shown, square and elongated ones; between two of the elongated electrodes, a barrier element is located to reach about the midst of the electrodes and a large droplet is moved back and through for re-suspension of magnetic beads, the droplet is deformed when passing the barrier element;

FIG. 17 a plane view of a linear array of elongated operation electrodes on a PCB of a digital microfluidics system; two sets of barrier elements are located between two of the elongated electrodes in each case, the two sets of barrier elements are located such that a large droplet is deformed on one side more than on the other when passing the first set of barrier elements and more deformed on the opposite side when passing the second set of barrier elements; moving the large droplet back and through and/or around both sets of barrier elements provides accelerated re-suspension of magnetic beads.

DETAILED DESCRIPTION OF THE PRESENT INVENTION

The inventive barrier elements, their combination with magnetic conduits with backing magnets and their use is now described in detail.

In the context of the present invention, an electrode array is a regular arrangement of electrodes, e.g. in an orthogonal lattice or in any other regular arrangement such as a linear or hexagonal array.

In the context of the present invention, a liquid droplet 8-1,8-1' has a size that covers on the hydrophobic surface 5 an area that is larger than a single individual electrode 2. Thus, a liquid droplet 8-1,8-1' is the smallest liquid volume that may be manipulated (i.e. transported) by electrowetting. In the context of the present invention, a liquid portion 8-2,8-2' has a size that covers on the hydrophobic surface 5 an area that is larger than two adjacent individual electrodes 2. Thus, a liquid portion 8-2,8-2' is larger than the smallest liquid volume that may be manipulated (i.e. transported) by electrowetting.

According to the present invention, in the first substrate 3 of the microfluidics system 1 and below said individual electrodes 2 there may be located at least one magnetic conduit 9 that is configured to be backed by a backing magnet 10. The term "below" is to be understood in the context of the present invention as "on the backside of the PCB to which's front-side the electrodes 2 are attached, no matter what spatial orientation the PCB may have. Further according to the present invention, said at least one magnetic conduit 9 is located in close proximity to individual electrodes 2 (see FIGS. 5-10 as described below).

FIG. 1 shows a biplanar setup basically known from the prior art (see e.g. WO 2010/069977). In the cross section view, a disposable cartridge 17 that comprises a first hydrophobic surface 5 and a second hydrophobic surface 6 with a working gap 4 in-between. The working gap 4 has gap height 28. The flat working film 19' of the disposable cartridge 17 is laying with its backside 21 on the uppermost surface 22 of the cartridge accommodation site 18 of a PCB 3 of a digital microfluidics system 1. An activated magnet 10 (preferably supported by a support 35) is located below at least one individual operation electrode 2 and a droplet 8-1 with magnetically responsive beads 11 is located in the magnetic field on top of the activated magnet 10. By the action of the magnetic field, the magnetically responsive beads 11 are concentrated within the droplet 8-1. A number or array of individual electrodes 2 are attached to a first substrate or PCB 3; these individual operating electrodes 2 are connected with and in operative contact to a central control unit 7. The control unit 7 is designed for controlling selection and for providing a number of said individual electrodes 2 that define a path of individual electrodes 2' with voltage for manipulating liquid portions 8-2 or liquid droplets 8-1 by electrowetting.

FIG. 2 shows the biplanar setup known from the prior art of the cross section view of FIG. 1. The droplet 8-1 with the magnetically responsive beads that previously have been clumped within the droplet 8-1 by the magnet field is moved away from the magnetic field by electrowetting action of the individual operation electrodes 2 of the PCB 3. Such moving away is controlled by the central control unit 7, but often has no or little influence on a re-suspension of the magnetically responsive beads in that droplet 8-1 whether or not the magnet 10 is activated. As can be seen, some magnetically responsive beads 1 may be retained in a small liquid portion 8" by the activated magnet 10.

FIG. 3 shows an inventive biplanar setup in a cross section view with a disposable cartridge 17 located at a cartridge accommodation 18 site of a PCB 3 of a digital microfluidics system 1. According to the present invention, two (or at least one) barrier elements 40 are located on two individual operation electrodes 2 adjacent to a single operation electrode 2. A droplet 8-1 with magnetically responsive beads 11 (e.g. previously clumped by a magnetic field) is situated on top another electrode on its path 2' (see FIGS. 12-15) to the at least one barrier element 40. Preferably, the microfluidics system 1 comprises a cartridge accommodation site 18 that is configured for taking up a disposable cartridge 17 (see for example US 2013/0134040).

A preferred and inventive method of keeping suspended or re-suspending magnetically responsive beads in liquid portions or droplets in digital microfluidics takes advantage of this setup and comprises the steps of a) providing a digital microfluidics system 1 comprising:
   - a number or array of individual electrodes 2 attached to a first substrate or PCB 3,
   - a central control unit 7 in operative contact with said individual electrodes 2 for controlling selection and for providing a number of said individual electrodes 2 that define a path of individual electrodes 2' with voltage for manipulating liquid portions 8-2 or liquid droplets 8-1 by electrowetting; and
   - a cartridge accommodation site 18 that is configured for taking up a disposable cartridge 17 which comprises a first hydrophobic surface 5 that belongs to a flexible working film 19, a second hydrophobic surface 6 that belongs to a cover plate 20 of the disposable cartridge 17, and a working gap 4 that is located in-between the two hydrophobic surfaces 5,6;

b) providing at least one barrier element 40 and positioning said barrier element 40 at least partially on an individual operating electrode 2 located at the cartridge accommodation site 18 of the PCB 3, the barrier element 40 narrowing the working gap 4 of a disposable cartridge 17 situated on a surface of said cartridge accommodation site 18;

c) providing a disposable cartridge 17 and positioning said disposable cartridge 17 at a cartridge accommodation site 18 of said digital microfluidics system 1; the flexible working film 19 comprising a backside 21 that, when the disposable cartridge 17 is accommodated on said cartridge accommodation site 18, touches an uppermost surface 22 of the cartridge accommodation site 18 of the digital microfluidics system 1 and of said at least one barrier element 40;

d) providing on the hydrophobic surface 5 and above a path of selected electrodes 2' at least one liquid portion 8-2 or liquid droplet 8-1 containing magnetically responsive beads 11; and e) moving by electrowetting said at least one liquid portion 8-2 or liquid droplet 8-1 containing magnetically responsive beads 11 on said path of selected electrodes 2' at least once over and/or around said at least one barrier element 40 and thereby keeping suspended or re-suspending the magnetically responsive beads 11 in said liquid portion 8-2 or liquid droplet 8-1.

Carrying out the step b) produces a narrowed gap height 46 that is reduced with respect to the normal gap height 28, which is defined by a gasket 27 that preferably belongs to the disposable cartridge 17 or to the cartridge accommodation site 18 of the microfluidics system 1.

FIG. 4 shows the inventive biplanar setup of the cross section view of FIG. 3. There is shown a result of the above preferred method of keeping suspended or resuspending magnetically responsive beads in liquid portions or droplets in digital microfluidics. The droplet 8-1 has been moved at least once (preferably repeatedly, see double arrow) over and/or around at least one of the barrier elements 40, and now, the droplet 8-1 comprises re-dispersed magnetically responsive beads 11.

When carrying out the above preferred method of keeping suspended or re-suspending magnetically responsive beads in liquid portions or droplets in digital microfluidics, it is preferred that for spreading of the flexible working film 19 of the disposable cartridge 17 on the uppermost surface 22 of the cartridge accommodation site 18 of the digital microfluidics system 1 and over said at least one barrier element 40:

- an underpressure is established between the uppermost surface 22 of the cartridge accommodation site 18 and the backside 21 of the flexible working film 19 of the disposable cartridge 17, using a vacuum source 23 of the digital microfluidics system 1; or
- an overpressure is established within the working gap 4 of the disposable cartridge 17, using a filler-fluid or other fluid.

For applying such underpressure, there are vacuum lines 23' preferably arranged in the microfluidics device 1, the vacuum lines 23' connecting an evacuation space 24 with the vacuum source 23 of the digital microfluidics system 1. According to the present invention, such evacuation space 24 is defined by the flexible working film 19 of the cartridge 17, a gasket 27, and the uppermost surface 22 of the cartridge accommodation site 18. This vacuum source 23 of the digital microfluidics system 1 is configured for establishing an underpressure in an evacuation space 24 between the uppermost surface 22 of the cartridge accommodation site 18 and the backside 21 of the working film 19 of a disposable cartridge 17 that is accommodated at the cartridge accommodation site 18 (see e.g. US 2013/0134040 A1).

When working with underpressure or overpressure as described, it is further preferred that the cover plate 20 of the disposable cartridge 17 is configured as a rigid cover plate, evenly defining a top of said working gap 4. For applying such overpressure inside the working gap 4, a filler fluid (e.g. silicone oil) or another fluid that preferably is not miscible with the droplets or liquid portions that are to be manipulated within the working gap 4 is pressed into the working gap 4.

FIG. 5 shows an alternative biplanar setup in a cross section view with a disposable cartridge 17 located at a cartridge accommodation 18 site of a PCB 3 of a digital microfluidics system 1. One conical or pyramidal magnetic conduit 9" is located in a PCB or first substrate 3 and backed with an activated, individual backing magnet 10. Preferably, such a backing magnet is a movable permanent magnet 10' (see FIG. 10), a switchable permanent magnet 10" (see FIGS. 7-9), or an electromagnet 10'" (see FIGS. 5-6). Here, the magnetic conduit 9" is located in a blind hole below a space 14 between two narrowed operation electrodes 2". As shown, in the first substrate 3 of the microfluidics system 1 and located in a blind hole below a space 14 between two narrowed operation electrodes 2", there is located a magnetic conduit 9" that is configured to be backed by a backing magnet 10, said at least one magnetic conduit 9 being located in close proximity to individual electrodes 2".

On this first hydrophobic surface 5, magnetically responsive beads 11 in the liquid droplet 8-1 are attracted by the magnetic field produced by the activated electromagnet 10'" and directed by the magnetic conduit 9".

FIG. 6 shows the alternative biplanar setup of the cross section view of FIG. 5 with the droplet 8-1' moved away from the magnetic conduit 9". Because the magnetic field delivered by the magnetic conduit 9" attracts most of the magnetically responsive beads 11, the liquid droplet 8-1' comprises a considerably reduced number of beads 11 leaving a small liquid portion 8" with beads 11 behind.

FIG. 7 shows an inventive biplanar setup in a cross section view with a disposable cartridge 17 located at a cartridge accommodation site 18 of a PCB 3 of a digital microfluidics system 1. The PCB 3 is equipped with one frustoconical magnetic conduit 9" located, which is backed with an activated, individual backing magnet 10" in combination with two barrier elements 40 at least partially located on two individual operation electrodes 2" adjacent to the magnetic conduit 9". The magnetic conduit 9" is located in a blind hole below neighboring notches 12 between two narrowed operation electrodes 2" and has a liquid droplet 8-1 with concentrated magnetically responsive beads 11 on top.

On this first hydrophobic surface 5, magnetically responsive beads 11 in the liquid droplet 8-1 are attracted by the magnetic field produced by the switchable permanent magnet 10" and directed by the magnetic conduit 9". Because the magnetic field of the permanent magnet of the PE-magnet is not compensated by the electromagnet of the PE-magnet. Such PE-magnets 32 (e.g. ITS-PE 1212-24 VDC-TEC of M RED MAGNETICS® (Intertec Components GmbH, 85356 Freising, Germany) may have a diameter of 12 mm, a height of 12 mm, and work with 24 V DC. A great advantage of using such PE-magnets 32 is the fact that absolutely no moving parts are involved or necessary for switching on and off the switchable permanent magnets 10". Preferably, the microfluidics system 1 comprises a cartridge accommodation site 18 that is configured for taking up a disposable cartridge 17 (see for example US 2013/0134040, herein incorporated by reference in its entirety).

A preferred and inventive method of substantially removing magnetically responsive beads from liquid portions or droplets in digital microfluidics takes advantage of this setup and comprises the steps of:

a) providing a digital microfluidics system 1 comprising:
   - a number or array of individual electrodes 2 attached to a first substrate or PCB 3;
   - a central control unit 7 in operative contact with said individual electrodes 2 for controlling selection and for providing a number of said individual electrodes 2 that define a path of individual electrodes 2' with voltage for manipulating liquid portions 8-2 or liquid droplets 8-1 by electrowetting;
   - a cartridge accommodation site 18 that is configured for taking up a disposable cartridge 17 which comprises a first hydrophobic surface 5 that belongs to a flexible working film 19, a second hydrophobic surface 6 that belongs to a cover plate 20 of the disposable cartridge 17, and a working gap 4 that is located in-between the two hydrophobic surfaces 5,6; and
   - at least one magnetic conduit 9 located in the first substrate or PCB 3 of the microfluidics system 1 and below said individual electrodes 2, said at least one magnetic conduit 9 being backed by a backing magnet 10 with a magnetic field, being configured for directing said magnetic field through the magnetic conduit 9 to the first hydrophobic surface 5 on said individual electrodes 2, and being located in close proximity to individual electrodes 2;

b) providing at least one barrier element 40 and positioning said barrier element 40 at least partially on an individual operating electrode 2 located at the cartridge accommodation site 18 of the PCB 3, the barrier element 40 narrowing the working gap 4 of a disposable cartridge 17 situated on a surface of said cartridge accommodation site 18;

c) providing a disposable cartridge 17 and positioning said disposable cartridge 17 at a cartridge accommodation site 18 of said digital microfluidics system 1; the flexible working film 19 comprising a backside 21 that, when the disposable cartridge 17 is accommodated on said cartridge accommodation site 18, touches an uppermost surface 22 of the cartridge accommodation site 18 of the digital microfluidics system 1 and of said at least one barrier element 40;

d) providing on the hydrophobic surface 5 and above a path of selected electrodes 2' at least one liquid portion 8-2 or liquid droplet 8-1 that comprises magnetically responsive beads 11;

e) moving by electrowetting said at least one liquid portion 8-2 or liquid droplet 8-1 with the magnetically responsive beads 11 on said path of selected electrodes 2' until said magnetic field of the at least one magnetic conduit 9 backed by a backing magnet 10 is reached; and f) activating said backing magnet 10 before and during moving by electrowetting said at least one liquid portion 8-2 or liquid droplet 8-1 with the magnetically responsive beads 11 on said path of selected electrodes 2' and over and/or around said at least one barrier element 40, thereby attracting and substantially removing magnetically responsive beads 11 from said liquid portion 8-2 or liquid droplet 8-1.

FIG. 8 shows the inventive biplanar setup of the cross section view of FIG. 7 with the droplet 8-1' moved away from the magnetic conduit. There is shown a result of the above preferred method of substantially removing magnetically responsive beads from liquid portions or droplets in digital microfluidics. The droplet 8-1' substantially comprises no beads 11 leaving a small liquid portion 8" with practically all magnetically responsive beads behind.

When carrying out the above removing method, on the one hand it is preferred for spreading the flexible working film 19 of the disposable cartridge 17 on the uppermost surface 22 of the cartridge accommodation site 18 of the digital microfluidics system 1 and over said at least one barrier element 40 to using a vacuum source 23 of the digital microfluidics system 1 for establishing an underpressure in an evacuation space 24 between the uppermost surface 22 of the cartridge accommodation site 18 and the backside 21 of the flexible working film 19 of the disposable cartridge 17.

When carrying out the above removing method, on the other hand it is preferred for spreading the flexible working film 19 of the disposable cartridge 17 on the uppermost surface 22 of the cartridge accommodation site 18 of the digital microfluidics system 1 and over said at least one barrier element 40 to using a filler-fluid or other fluid for establishing an overpressure within the working gap 4 of the disposable cartridge 17.

Preferably for carrying out the above removing method in one way or the other, the cover plate 20 of the disposable cartridge 17 is configured as a rigid cover plate, evenly defining a top of said working gap 4.

It is preferred that said at least one magnetic conduit 9 consists of a single solid ferromagnetic element, or of a multitude of randomly orientated ferromagnetic elements, or of an amorphous paste filled with ferromagnetic material. It is further preferred that said at least one magnetic conduit 9 is located under and is covered by an individual electrode 2 or that said at least one magnetic conduit 9 is located beside of and is not covered by at least one individual electrode 2.

The backing magnet 10 that is used to operatively back at least one magnetic conduit 9, preferably is configured as a movable permanent magnet 10' (see FIG. 10), or as a switchable permanent magnet 10" (see FIGS. 7-9), or as an electromagnet 10'" (see FIGS. 5-6).

In consequence, actuating said backing magnet (10) is achieved by:

a) moving a permanent magnet 10' to a backside of the at least one magnetic conduit 9; or
b) switching-on a switchable permanent magnet 10" that is located at the backside of the at least one magnetic conduit 9; switching-on a switchable permanent magnet 10" is carried out by switching-off an electromagnet that is compensating the magnetic field of a PE-magnet; or
c) energizing an electromagnet 10'" that is located at the backside of the at least one magnetic conduit 9.

Preferably, said at least one magnetic conduit 9 is a cylindrical, cuboid, pyramidal, frustoconical, conical, or magnetic conduit 9',9" located in a blind hole 15 or in a through hole 16 in the first substrate 3 of the digital microfluidics system 1.

Independent from the method of working, it is preferred that the cartridge accommodation site 18 of the digital microfluidics system 1 or the disposable cartridge 17 comprise a gasket 27, using which said evacuation space 24 (if present) is sealingly enclosed and always, a height 28 of the working gap 4 between said hydrophobic surfaces 5,6 of the disposable cartridge 17 is defined.

When working with overpressure in the gap 4, it is preferred that the cartridge accommodation site 18 of the digital microfluidics system 1 comprises at least one check valve 42, using which said working gap 4 is sealingly closed and an overpressure produced by a filler fluid or other fluid inside said working gap 4 is enabled (see FIG. 11).

FIG. 9 shows the inventive biplanar setup of the cross section view of FIGS. 7 and 8 with the droplet 8-1 moved back to the magnetic conduit 9" with the now deactivated backing magnet 10. All magnetically responsive beads 11 are present again and dispersed in the droplet 8-1. Such re-suspension was achieved by moving by electrowetting said liquid droplet 8-1 containing magnetically responsive beads 11 on said path of selected electrodes 2' at least once over and/or around said at least one barrier element 40 and thereby re-suspending the magnetically responsive beads 11 in said liquid droplet 8-1.

FIG. 10 shows an inventive biplanar setup in a cross section view with a disposable cartridge 17 located at a cartridge accommodation site 18 of a PCB 3 of a digital microfluidics system 1. One cylindrical magnetic conduit 9' is located below the center of an electrowetting electrode 2, the magnetic conduit 9' being located in the PCB 3 or first substrate 3 and backed with an activated, individual backing magnet 10 in combination with a single barrier element 40 located on an individual operation electrode 2 adjacent to the magnetic conduit 9". Here and in contrast to the barrier elements 40 shown so far, the barrier element 40 shows a trapezoid cross section instead of a square or rectangular cross section.

Using barrier elements 40 with rectangular cross section is preferred when working with "low" underpressure in the range of about −2 psi (which is equal to 875 mbar). The low underpressure does not attract the entire flexible working film 19, which thus forms ramp-like transitions between the normal gap height 28 and the narrowed gap height 46.

Using barrier elements 40 with trapezoid cross section is preferred when working with "high" underpressure in the range of about −6 psi (which is equal to 600 mbar). The high underpressure does attract the entire flexible working film 19. The preferred ramp-like transitions between the normal gap height 28 and the narrowed gap height 46 are defined by the trapezoid flanks of the barrier elements 40.

When using such high underpressure, avoidance of bubbles inside the gap 4 has been observed. This effect is most likely supported or due by a semi-permeable constitution or property of the flexible working film 19.

The liquid droplet 8-1' has been moved over and/or around the barrier element 40 and comprises practically no magnetically responsive beads 11. A small liquid portion 8" with substantially all beads is left behind on top of the magnetic conduit 9".

It is to be noted that here, a movable permanent magnet 10' is depicted. The permanent magnet 10' is supported by a movable support 35. In this case, the support 35 is turnable around an axis (see dashed double arrow and chain dotted line). In order to move the permanent magnet away from and again to the magnetic conduit 9, also other sorts of movement, such as sliding or lifting are possible too.

FIG. 11 shows an inventive biplanar setup in a cross section view with a disposable cartridge 17 located at a cartridge accommodation site 18 of a PCB 3 of a digital microfluidics system 1. The microfluidics system 1 comprising two check valves 42 located between electrowetting electrodes 2. The location of one check valve close to one electrowetting electrode 2 would be sufficient for delivery of liquids, such as filler fluid, sample portions, reagents as well. The check valves 42 each are located in the PCB or first substrate 3 and in projection under (or opposite to) a pipetting guide 41 of the disposable cartridge 17.

The check valve 42 on the left is closed by pushing the valve ball 43 up by the valve spring 44. This pushing up lifts the flexible working film 19 and presses it against an opening of the pipetting guide 41 of the disposable cartridge 17 that is inserted in or attached to the ridge accommodation site 18 of a PCB 3 of a digital microfluidics system 1. In consequence, establishing an overpressure in the filler fluid inside of the working gap 4 is enabled.

The check valve 42 on the right is open by pressing a liquid (here a sample portion) via the sealing pipetting guide 41 into the working gap 4 of the disposable cartridge 17. The pipette tip 47 used (preferably a disposable polypropylene pipette tip) is pushed into the pipetting guide 41 such that its circumference is sealingly pressed against the pipetting guide 41. When doing this, the pipette tip 47 pushes about halfway down the working gap height 28 the valve ball 43 against the force of the valve spring 44. Liquid injection additionally moves the valve ball 43 against the force of the valve spring 44 and opens the check valve more. Such injecting of liquid portions gradually enhances the internal pressure inside of the working gap 4, whereupon the flexible working film 19 of the disposable cartridge 17 more evenly spreads on the uppermost surface 22 of the cartridge accommodation site 18 of the digital microfluidics system 1 and over said at least one barrier element 40.

The pipetting guides 41 may be sealed and blocked by pushing-in cones 48 of appropriate size and shape. However, these cones 48 shall not reach to the inside of the working gap 4. Alternatively, the pipetting guides 41 may be sealed with portions of liquid wax poured-in, which portions then solidify. For removing and disposing a disposable cartridge 17 equipped with pipetting guides 41 and with an overpressure inside the working gap 4, such blocking of all pipetting guides 41 is advisable for safety reasons. It is feasible that, when removing such a sealed disposable cartridge 17 from the cartridge accommodation site 18 of a digital microfluidics system 1, the overpressure previously applied to the working gap is balanced by the flexibility of the working film 19. This is even more so, if a number of barrier elements 40 have been placed on the uppermost surface 22 of that cartridge accommodation site 18.

It may be required to add underpressure to the working film 19 from the outside. For this purpose, it is preferred to additionally equip the digital microfluidics system 1 with a vacuum source 23 that is linked to the uppermost surface 22 of the that cartridge accommodation site 18 by vacuum lines 23'.

FIG. 12 shows a plane view of a linear array of operation electrodes 2 on a PCB 3 of a digital microfluidics system 1. A single magnetic conduit 9 is positioned on an activated backing magnet 10 (not shown) that is located below a central void 13 in the center of an electrowetting electrode 2 that belongs to a path 2' of a liquid droplet 8-1'. Two barrier elements 40 according to a first embodiment of the current invention are at least partially located on two individual operation electrodes 2 adjacent to the electrode 2 with the magnetic conduit 9. The liquid droplet 8-1' has been moved on the first hydrophobic surface 5 of the flexible working film 19 away from the electrode 2 with the magnetic conduit 9 and over a barrier element 40. Thus, the liquid droplet 8-1' substantially comprises no magnetically responsive beads 11 leaving a small liquid portion 8" with practically all beads 11 behind on top of the magnetic conduit 9. In this case, two rectangular barrier elements 40 with rectangular cross sections have been deposited to the uppermost surface 22 of the cartridge accommodation site 18.

FIG. 13 shows a plane view of a linear array of operation electrodes 2 on a PCB 3 of a digital microfluidics system 1. A single magnetic conduit 9 is located in neighboring notches 12 in-between two of narrowed electrowetting electrodes 2". The electrodes 2,2" define the path of electrodes 2' selected for electrowetting. The magnetic conduit 9 is positioned on an activated backing magnet 10 (not shown). Two barrier elements 40 according to a second embodiment are at least partially located on two individual operation electrodes 2" adjacent to the magnetic conduit 9. The liquid droplet 8-1' is being moved on the first hydrophobic surface 5 of the flexible working film 19 away from the magnetic conduit 9 and over a barrier element 40. Thus, the liquid droplet 8-1' substantially comprises no magnetically responsive beads and a small liquid portion 8" with practically all beads is left behind on top of the magnetic conduit 9. In this case, two rectangular barrier elements 40 with trapezoid cross sections have been deposited to the uppermost surface 22 of the cartridge accommodation site 18.

FIG. 14 shows a plane view of a linear array of operation electrodes 2 on a PCB 3 of a digital microfluidics system 1. A single magnetic conduit 9 is located in a notch 12 at one side of one of the electrowetting electrodes 2 that define the electrowetting path 2'. The magnetic conduit 9 is positioned on an inactive backing magnet 10 (not shown). Two barrier elements 40 according to a third and fourth embodiment are at least partially located on two individual operation electrodes 2 adjacent to the narrowed electrode 2" with the magnetic conduit 9 on which is the liquid droplet 8-1 that comprises all dispersed magnetically responsive beads 11. Moving on the first hydrophobic surface 5 of the flexible working film 19 back and fro over and/or around one or the other (or both) barrier elements 40 keeps the magnetically responsive beads 11 in suspension.

In this case on the left side, an angled barrier element 40 has been deposited to the uppermost surface 22 of the cartridge accommodation site 18; the broader, angled central part having a rectangular cross section and the smaller, angled extension parts having a square cross section.

In this case on the right side, two broad, angled barrier elements 40 have been deposited to the uppermost surface 22 of the cartridge accommodation site 18. Both broad, angled barrier elements 40 have a rectangular cross section and are not touching each other; thus, an open passage is left between them.

While the droplet 8-1 may be moved over the barrier element 40 on the left, it may be moved around (i.e. through the open passage between) the barrier elements 40 on the right.

FIG. 15 shows a plane view of a linear array of operation electrodes 2 on a PCB 3 of a digital microfluidics system 1. A single magnetic conduit 9 is located in a notch 12 at one side of one of a narrowed electrowetting electrode 2" that defines the electrowetting path 2'. The magnetic conduit 9 is positioned on an activated backing magnet 10. Two barrier elements 40 according to a fifth and sixth embodiment are at least partially located on two individual operation electrodes 2 adjacent to the electrode 2" with the magnetic conduit 9. The liquid droplet 8-1' is being moved on the first hydrophobic surface 5 of the flexible working film 19 away from the magnetic conduit 9 and over a barrier element 40. In consequence, the liquid droplet 8-1' substantially comprises no beads and a small liquid portion 8" with practically all magnetically responsive beads 11 is left behind on top of the magnetic conduit 9.

In this case on the left side, an broad, angled barrier element 40 has been deposited to the uppermost surface 22 of the cartridge accommodation site 18; the broad, angled barrier element 40 having a trapezoid cross section over its entire length.

In this case on the right side, an angled barrier element 40 has been deposited to the uppermost surface 22 of the cartridge accommodation site 18. Two broad, angled parts of the barrier element 40 have a rectangular cross section and are connected to each other by a small, straight part of the barrier element 40 with a square cross section.

While the droplet 8-1 may be moved over the barrier element 40 on the left, it may partly be moved around and partly moved over the barrier element 40 on the right.

FIG. 16 shows a plane view of a linear array of operation electrodes 2 on a PCB 3 of a digital microfluidics system 1. Two types of electrodes 2 are shown, square and elongated ones. Between two of the elongated electrodes 2, a barrier element 40 is located to reach about the midst of the electrodes 2 and a large liquid portion 8-2 is moved on the first hydrophobic surface 5 of the flexible working film 19 back and through for re-suspension of magnetic beads 11 therein. The liquid portion 8-2 is deformed when passing the barrier element 40 (the dashed line is showing the normal shape and the full line is showing the deformed shape of the liquid portion 8-2). Such deformation introduces internal movement within the liquid portion 8-2 and increases effectiveness of suspending the beads 11. The large straight barrier element 40 preferably has a trapezoid cross section over its entire length. The liquid portion 8-2 is moved partly around and partly over the barrier element 40.

FIG. 17 shows a plane view of a linear array of elongated operation electrodes 2 on a PCB 3 of a digital microfluidics system 1. Two sets of barrier elements 40 are located between two of the elongated electrodes 2 in each case. The two sets of barrier elements 40 are located such that a large liquid portion 8-2 is deformed on one side more than on the other when passing the first set of barrier elements 40. The large liquid portion 8-2 is more deformed on the opposite side when passing the second set of barrier elements 40. Moving the large liquid portion 8-2 back and through both sets of barrier elements 40 provides accelerated re-suspension of magnetic beads 11. The large straight barrier elements 40 preferably have a trapezoid cross section over their entire length. The liquid portion 8-2 is moved partly around and partly over the barrier elements 40.

Preferably, an inventive digital microfluidics system 1 configured for substantially removing or suspending magnetically responsive beads from or in liquid portions or droplets comprises, (a) a number or array of individual electrodes 2 attached to a first substrate or PCB;

(b) a central control unit 7 in operative contact with said individual electrodes 2 for controlling selection and for providing a number of said individual electrodes 2 that define a path of individual electrodes 2' with voltage for manipulating liquid portions 8-2 or liquid droplets 8-1 by electrowetting; and (c) a cartridge accommodation site 18 that is configured for taking up a disposable cartridge 17 which comprises a first hydrophobic surface 5 that belongs to a flexible working film 19, a second hydrophobic surface 6 that belongs to a cover plate 20 of the disposable cartridge 17, and a working gap 4 that is located inbetween the two hydrophobic surfaces 5,6; the flexible working film 19 comprising a backside 21 that, when the disposable cartridge 17 is accommodated on a cartridge accommodation site 18 of the digital microfluidics system 1, touches an uppermost surface 22 of the cartridge accommodation site 18 of the digital microfluidics system 1;

wherein the digital microfluidics system 1 further comprises at least one barrier element 40 positioned at least partially on an individual operating electrode 2 located at the cartridge accommodation site 18 of the PCB 3, the barrier element 40 narrowing the working gap 4 of a disposable cartridge 17 situated on a surface of said cartridge accommodation site 18.

Preferably, said least one barrier element 40 comprises a material chosen of a group of materials, said group comprising Kapton® tape, Teflon® sheets, solder mask and silk screen printing, and paper strips.

Preferably, said least one barrier element 40 has a thickness of 0.02 to 0.25 mm, a width of 0.4 to 1.0 mm, and a length of 3 to 5 mm.

Preferably, said least one barrier element 40 has a cross section in a trapezoid, rectangular, or square shape. Combinations of these shapes are possible and preferred too.

Preferably, in combination with a mixing zone of the electrode path 2', one, two, or four barrier elements 40 are provided.

Preferably, in the first substrate or PCB 3 of the microfluidics system 1 and below said individual electrodes 2 there is located at least one magnetic conduit 9 that is backed by a backing magnet 10, said at least one magnetic conduit 9 being located in close proximity to individual electrodes 2.

Preferably, said at least one magnetic conduit 9 is located under and is covered by an individual electrode 2.

Preferably, said at least one magnetic conduit 9 is located beside of and is not covered by at least one individual electrode 2.

Preferably, said backing magnet 10 is configured as a moving permanent magnet 10', a switchable permanent magnet 10", or as an electromagnet 10".

Preferably, in combination with a magnetic conduit 9 and a backing magnet 10, one or two barrier elements 40 are provided.

Preferably, the digital microfluidics system 1 comprises a vacuum source 23 for establishing an underpressure in an evacuation space 24 between the uppermost surface 22 of the cartridge accommodation site 18 and the backside 21 of the flexible working film 19 of the disposable cartridge 17.

Preferably, the cartridge accommodation site 18 of the digital microfluidics system 1 comprises at least one check valve 42 configured to sealingly close the working gap 4 and to enable an overpressure in a filler fluid or other fluid inside said working gap 4.

Preferably, the cartridge accommodation site 18 of the digital microfluidics system 1 comprises a pressure sensor for measuring the actual underpressure between the uppermost surface 22 of the cartridge accommodation site 18 and the flexible working film 19 of the disposable cartridge 17. If an underpressure is to be established, a pressure of −2 psi to −6 psi i.e. 875 to 600 mbar is preferred.

Preferably, the cartridge accommodation site 18 of the digital microfluidics system 1 comprises a pressure sensor for measuring the actual overpressure between the uppermost surface 22 of the cartridge accommodation site 18 and the flexible working film 19 of the disposable cartridge 17.

It is evident from this description that the liquid droplets 8-1,8-1' or liquid portions 8-2,8-2' with or without magnetically responsive beads 11 in each case may also be moved from the right to the left of the shown electrode paths 2'. It is further evident from this description that such movements can also be directed in any other direction of an electrode array. Moreover, inverse movements and inverse actions on the removal of magnetically responsive beads 11 from liquid droplets 8-1 or liquid portions 8-2 as well as on the suspension of magnetically responsive beads 11 within liquid droplets 8-1' or liquid portions 8-2' are disclosed and evident from the present description and drawings.

In general, the magnetic conduits 9,9',9" according to the present invention preferably consist of or comprises material with the potential for a high degree of magnetization. The type of material that can be a ferromagnetic element (iron, nickel, cobalt) or an alloy (permalloy, Kovar, mu-metal, stainless-steel 410). The magnetic conduits 9 according to the present invention may comprise a single solid ferromagnetic element, or of a multitude of randomly orientated ferromagnetic elements (e.g. metallic shavings, preferably iron shavings), or of an amorphous paste filled with ferromagnetic material (e.g. magnetic epoxy). Preferably, the ferromagnetic material is kept inside a magnetic conduit 9 with epoxy or with a tape at the bottom of the magnetic conduit 9 or of the PCB 3.

In general, the magnetic conduits 9 according to the present invention can be located in a through hole or in a blind hole. Blind holes provide less magnetic coupling than the through holes. Both allow the use of vertical electrical vias in the PCB 3. The blind holes allow better electrical insulation and pressure difference between the uppermost surface 22 of the cartridge accommodation site 18 or PCB 3 and the bottom surface of the PCB or first substrate 3. Typically but not exclusively, the voltage in a digital microfluidics system 1 is applied in pulses to one or more selected electrodes 2' that define one or more paths for one or more liquid portions 8-2 or liquid droplets 8-1 (see for example US 2013/0134040 A1 and US 2013/0175169 A1, herein incorporated by reference in their entirety).

Preferably and in general, the backing magnet 10 is configured as a permanent magnet 10', or as a switchable permanent magnet 10", or as an electromagnet 10'". Most preferred are permanent magnets 10' or switchable permanent magnets 10". Such backing magnets 10 may be activated by a selection of the following alternatives:

a) Moving a permanent magnet 10' to the backside of the at least one specific magnetic conduit 9. Such moving a permanent magnet 10' may be carried out e.g. by lifting, or by swinging, or by rotating the permanent magnet 10' until its magnetic field is aligned with the at least one specific magnetic conduit 9. Means for enabling such moving a permanent magnet 10' to the backside of the at least one specific magnetic conduit 9 may be conceived by a person of average skill in the art. Such means preferably comprise a support 35 for holding at least one backing magnet 10.

b) Switching on a switchable permanent magnet 10" that is located at the backside of the at least one specific magnetic conduit 9. Such switching on a switchable permanent magnet 10" may be carried out e.g. by turning a permanent magnet into an "ON" position of a magnetic base 29 or by switching off an electromagnet 33 that is compensating the magnetic field of a PE-mag-net 32. A particularly preferred PE-magnet is the ITS-PE 1212-24 VDC-TEC of M RED MAGNETICS® (Intertec Components GmbH, 85356 Freising, Germany).

c) Energizing an electromagnet 10'" that is located at the backside of the at least one specific magnetic conduit 9.

It is noted expressly that all features in the shown and described embodiments that appear reasonable to a person of skill may be combined with each and every one of these features. Especially preferred materials and dimensions are disclosed in Table 1 below: Cytop is an amorphous fluoropolymer with high optical transparency (AGC Chemicals Europe). Mylar®, Neoprene®, Teflon®, and Viton® are Trademarks of DuPont, Wilmington, USA.

Preferably, the magnetic conduits 9 are in physical contact or in close proximity to the backing magnet 10 when the magnetic force is enabled. Preferred distances (if there are some) range from 1 μm to 1 mm, more preferably from 1 μm to 100 μm.

In some embodiments, the permanent magnet height is 5 mm-20 mm, preferably 10 mm-15 mm with a diameter of preferably 3 mm-7 mm. If a single, large permanent magnet is used, the magnet length can be 30-100 mm, preferably 50 mm-70 mm. The magnetic force generated on a single 1-μm-diameter magnetic bead is 100 fN-10 pN, preferably 500 fN-2 pN.

Even if not particularly described in each case, the reference numbers refer to similar elements of the digital microfluidics system 1 and in particular of the disposable cartridge 17 of the present invention. All drawings are schematic and not to scale.

TABLE 1

| Part | No | Material | Dimension and Shape |
|---|---|---|---|
| Liquid portion or droplet | 8 | Aqueous, alcohol | Volume: 0.1-25 μl |
| First Substrate | 3 | PCB; synth. Polymer; Cu | Thickness about 1.6 mm |
| Electrodes | 2 | Al; Cu; Au; Pt | Plating, preferably: 1.375 mm × 1.375 mm |
| Working film | 19 | Fluorinated ethylene propylene (FEP), Cyclo olefin polymer (COP), Polypropylene (PP) | Foil: 8-50 μm |
| $1^{st}$ hydrophobic surface | 5 | COP, FEP, PP | Foil: 8-50 μm |
| Second substrate or Cover plate | 36<br>20 | Mylar ®; acrylic;<br>Polypropylene (PP) | Plate: 0.5-10.0 mm; preferably 1.5 mm |
| $2^{nd}$ hydrophobic surface | 6 | Teflon ® (PTFE), amorphous fluoropolymer | Spin coating: 5-500 nm; preferably 20 nm |
| Gap height | 28 | — | 0.3-2.0 mm; preferably 0.5 mm |
| Pipetting orifice | — | — | Diameter: 0.3-3.0 mm |
| Body | — | Mylar ®; acrylic; Polypropylene (PP) | 127 × 85 mm; 6-25 mm |
| Magnetic conduit | 9 | Cylindrical preferred | Diameter up to 3 mm |
| Gasket | 27 | Synthetic or natural rubber | Frame: 0.2-2.0 mm; preferably 0.5 mm |
| Seal | — | Viton ®; Neoprene ® | O-ring Ø 3.0 mm |
| Insertion guide | — | Al; Al/Mg; steel; Teflon ® (PTFE) | Frame: 5-30 mm |
| Dielectric layer | — | Fluorinated ethylene propylene (FEP) | Foil or casting: 20-100 μm |
| Hydrophobic layer | — | FEP; PTFE; Teflon ® AF; Cytop; Cytonix | 2-200 nm |
| Filler fluid; Oil | — | Silicone | Volume: 1-5 ml |
| Underpressure | | (−2 psi to −6 psi) | 875 to 600 mbar |
| Electrically conductive material | — | Au, Pt, ITO, PP, PA | Layer: 20-100 μm; preferably 50 μm |
| Barrier element | 40 | Kapton ® tape, Teflon ® sheets, solder mask and silk screen printing, paper strips | Thickness: 0.02-0.25 mm<br>Size: (0.4-1.0 mm) (3-5 mm)<br>Cross section: square, rectangular, trapezoid |

REFERENCE NUMBERS

1 digital microfluidics system
2 individual (operating, electro-wetting) electrode
2' path of selected (operating, electrowetting) electrodes, droplet path, electrode path
2" narrowed individual (operating, electrowetting) electrode
3 first substrate or PCB
4 working gap
5 first hydrophobic surface
6 second hydrophobic surface
7 central control unit
8-1 liquid droplet with magnetic beads

8-1' liquid droplet without magnetic beads
8-2 liquid portion with magnetic beads
8-2' liquid portion without magnetic beads
8" small liquid portion with magnetic beads
9 magnetic conduit
9' cuboid, cylindrical magnetic conduit
9" pyramidal, frustoconical magnetic conduit
10 backing magnet; magnet
10' movable permanent magnet
10" switchable permanent magnet
10'" electromagnet
11 magnetically responsive beads
12 neighboring notches, notch
13 central void
14 space
17 disposable cartridge
18 cartridge accommodation site
19 flexible working film
19' working film
20 cover plate
21 backside of 19,19'
22 uppermost surface of 18
23 vacuum source
23' vacuum line
24 evacuation space
25 cooperating magnetic conduit
26 cooperating magnet
27 gasket
28 height of 4
35 support for 10
40 barrier (obstacle) element
41 sealing pipetting guide
42 check valve
43 valve ball
44 valve spring
46 narrowed gap height
47 pipette tip
48 cone

What is claimed is:

1. A method of substantially removing magnetically responsive beads from liquid portions or droplets in digital microfluidics, wherein the method comprises the steps of:

a) providing a digital microfluidics system (1) comprising:

a number or array of individual electrodes (2) attached to a first substrate or PCB (3);

a central control unit (7) in operative contact with said individual electrodes (2) for controlling selection and for providing a number of said individual electrodes (2) that define a path of said individual electrodes (2') with voltage for manipulating liquid portions (8-2) or liquid droplets (8-1) by electrowetting;

a cartridge accommodation site (18) that is configured for taking up a disposable cartridge (17) which comprises a first hydrophobic surface (5) that belongs to a flexible working film (19), a second hydrophobic surface (6) that belongs to a cover plate (20) of the disposable cartridge (17), and a working gap (4) that is located in-between the first hydrophobic surface (5) and the second hydrophobic surface (6); and at least one magnetic conduit (9) located in the first substrate or PCB (3) of the microfluidics system (1) and below said individual electrodes (2), said at least one magnetic conduit (9) being backed by a backing magnet (10) with a magnetic field, being configured for directing said magnetic field through the magnetic conduit (9) to the first hydrophobic surface (5) on said individual electrodes (2), and being located in close proximity to said individual electrodes (2);

b) providing at least one barrier element (40) and positioning said barrier element (40) at least partially on at least one of said individual electrodes (2) located at the cartridge accommodation site (18) of the PCB (3), the barrier element (40) narrowing the working gap (4) of a disposable cartridge (17) situated on a surface of said cartridge accommodation site (18);

c) providing the disposable cartridge (17) and positioning said disposable cartridge (17) at a cartridge accommodation site (18) of said digital microfluidics system (1); the flexible working film (19) comprising a backside (21) that, when the disposable cartridge (17) is accommodated on said cartridge accommodation site (18), touches an uppermost surface (22) of the cartridge accommodation site (18) of the digital microfluidics system (1) and of said at least one barrier element (40);

d) providing on the hydrophobic surface (5) and above the path of individual electrodes (2') at least one liquid portion (8-2) or liquid droplet (8-1) that comprises magnetically responsive beads (11);

e) moving by electrowetting said at least one liquid portion (8-2) or liquid droplet (8-1) with the magnetically responsive beads (11) on said path of individual electrodes (2') until said magnetic field of the at least one magnetic conduit (9) backed by a backing magnet (10) is reached; and f) activating said backing magnet (10) before and during moving by electrowetting said at least one liquid portion (8-2) or liquid droplet (8-1) with the magnetically responsive beads (11) on said path of individual electrodes (2') and over and/or around said at least one barrier element (40), thereby attracting and substantially removing magnetically responsive beads (11) from said liquid portion (8-2) or liquid droplet (8-1).

2. The removing method of claim 1, wherein using a vacuum source (23) of the digital microfluidics system (1), an underpressure is established in an evacuation space (24) between the uppermost surface (22) of the cartridge accommodation site (18) and the backside (21) of the flexible working film (19) of the disposable cartridge (17), whereupon the flexible working film (19) of the disposable cartridge (17) spreads on the uppermost surface (22) of the cartridge accommodation site (18) of the digital microfluidics system (1) and over said at least one barrier element (40).

3. The removing method of claim 1, wherein using a filler-fluid or other fluid, an overpressure is established within the working gap (4) of the disposable cartridge (17), whereupon the flexible working film (19) of the disposable cartridge (17) spreads on the uppermost surface (22) of the cartridge accommodation site (18) of the digital microfluidics system (1) and over said at least one barrier element (40).

4. The removing method of claim 2, wherein the cover plate (20) of the disposable cartridge (17) is configured as a rigid cover plate, evenly defining a top of said working gap (4).

5. The removing method of claim 1, wherein said at least one magnetic conduit (9) consists of a single solid ferromagnetic element, or of a multitude of randomly orientated ferromagnetic elements, or of an amorphous paste filled with ferromagnetic material.

6. The removing method of claim 5, wherein said at least one magnetic conduit (9) is located under and is covered by at least one of the individual electrodes (2).

7. The removing method of claim 5, wherein said at least one magnetic conduit (9) is located beside of and is not covered by at least one of the individual electrodes (2).

8. The removing method of claim 5, wherein said backing magnet (10) is used to operatively back at least one magnetic conduit (9) and is configured as a permanent magnet (10'), or as a switchable permanent magnet (10"), or as an electromagnet (10'").

9. The removing method of claim 8, wherein actuating said backing magnet (10) is achieved by:

a) moving a permanent magnet (10') to a backside of the at least one magnetic conduit (9); or b) switching-on a switchable permanent magnet (10") that is located at the backside of the at least one magnetic conduit (9); or c) energizing an electromagnet (10'") that is located at the backside of the at least one magnetic conduit (9).

10. The removing method of claim 9, wherein switching-on a switchable permanent magnet (10") is carried out by switching-off an electromagnet (33) that is compensating the magnetic field of a permanent-electro magnet (32).

11. The removing method of claim 1, wherein said at least one magnetic conduit (9) is selected from the group consisting of a cylindrical, cuboid, pyramidal, frustoconical and conical, or a magnetic conduit (9',9") located in a blind hole (15) or in a through hole (16) in the first substrate (3) of the digital microfluidics system (1).

12. The removing method of claim 2, wherein the cartridge accommodation site (18) of the digital microfluidics system (1) or the disposable cartridge (17) comprise a gasket (27), using which said evacuation space (24) is sealingly enclosed and a height (28) of the working gap (4) between said hydrophobic surfaces (5,6) of the disposable cartridge (17) is defined.

13. The removing method of claim 1, wherein the cartridge accommodation site (18) of the digital microfluidics system (1) comprises at least one check valve (42), using which said working gap is sealingly closed and an overpressure produced by a filler fluid or other fluid inside said working gap is enabled.

* * * * *